United States Patent [19]

Zentner

[11] Patent Number: 4,944,513

[45] Date of Patent: Jul. 31, 1990

[54] BALL BATTING GAME APPARATUS

[76] Inventor: John R. Zentner, 22442 Bessemer, Woodland Hills, Calif. 91367

[21] Appl. No.: 321,294

[22] Filed: Mar. 7, 1989

[51] Int. Cl.[5] ..... A63B 69/40

[52] U.S. Cl. ..... 273/26 R; 273/26 B; 273/26 E; 273/26 EA; 273/29 R; 273/58 C; 273/67 R

[58] Field of Search ..... 273/25, 26 R, 26 A, 273/26 B, 26 D, 26 E, 26 EA, 28, 29 R, 29 A, 58 C, 60 R, 67 R, 88, 90

[56] References Cited

U.S. PATENT DOCUMENTS

| | | | |
|---|---|---|---|
| 2,680,022 | 6/1954 | Walden | 273/26 EA |
| 3,042,401 | 7/1962 | Denegre | 273/26 E |
| 3,086,775 | 4/1963 | Albert | 273/26 EA |
| 3,558,134 | 1/1971 | Hoitsma | 273/26 EA |
| 3,754,761 | 8/1973 | Pruss | 273/58 C |
| 3,924,855 | 12/1975 | Pretorius | 273/26 EA |
| 3,953,028 | 4/1976 | Gowins | 273/26 EA |

OTHER PUBLICATIONS

"Consumer Bulletin" Dec. 1962, p. 23 (273/26 E).

*Primary Examiner*—Edward M. Coven
*Assistant Examiner*—Raleigh W. Chiu
*Attorney, Agent, or Firm*—Albert O. Cota

[57] ABSTRACT

Ball batting apparatus for playing ball with one to three players which has a pair of spaced apart line attaching members (30) positioned a predetermined distance with a line (40) stretched therebetween. Line tensioners maintain the tautness of the line and a ball (56) with a hole (58) in the center thereof is slideably contained on the line. A ball striking device having extended fingers (60) allows a player to hit the ball with the fingers penetrating either side of the line. In one embodiment, a ball launching implement (72) is used by a second player to propel the ball with a flick of the wrist to the player having the striking device simulating a pitcher. In another embodiment, a third player acts as a catcher and manipulates the line (30) with an adjuster (96) simulating a curve or sliding pitch.

28 Claims, 5 Drawing Sheets

BALL BATTING GAME APPARATUS

TECHNICAL FIELD

The present invention relates to games in general employing balls and bats or rackets. More specifically to a game played by one or more players with a ball captivated on a taut line struck by a bat or racket simulating a parent game such as baseball, tennis, or the like, in restricted form.

BACKGROUND ART

Previously many types of games and training apparatus have been in use endeavoring to provide an effective teaching means or leisure time activity related to a particular sport. In most cases a ball is used in conjunction with a cable for retension, however, usually the ball is attached to a sliding element and then to the cable or it is captivated through the center with no striking object utilized at all.

A search of the prior art did not disclose any patents that read directly on the claims of the instant invention however, the following U.S. patents were considered related:

| U.S. PAT. NO. | INVENTOR | ISSUED | |
|---|---|---|---|
| 3,953,026 | Gowins | 27 April | 1976 |
| 3,754,761 | Pruss | 28 August | 1973 |
| 3,558,134 | Hoitsma | 26 January | 1971 |
| 3,550,937 | Wright, et al | 29 December | 1970 |
| 3,469,840 | Kruzel | 30 September | 1969 |

Gowins tethers a baseball that is attached to a sliding bushing along a guide wire. The wire is attached between a pair of frame members one having a spring loaded rebound board and the other a tension spring assembly. The tethered ball is hit by the batter striking the rebound board. The tension on the wire is accomplished by the use of an anchor bolt or the position of the supporting upright.

Pruss employs an inclined guiding string anchored on one end to a stake in the ground and on the other to a far end of a rod or some other solid object. A golf ball is attached to a ring which slides up the string when hit with a golf club.

Hoitsma teaches ball throwing techniques using a pair of spaced apart standards with a guide wire therebetween. A plurality of balls, fitted with diametrically extending sleeves of metal, are threaded on the wire and thrown teaching arm movements for improving accuracy. No bat or striking instrument is employed.

Wright attaches a basketball on a tubular guide which is slideably mounted on a track consisting of a line, cable or the like. The track is fixed on the floor on one end and the ceiling on the other. A stop, preferably made of a rubber block, limits the downward travel of the ball.

Finally, in patent '840 issued to Kruzel, a pitching and batting device is disclosed consisting of a traverse line between screw eyes to which a pulley is attached. A tethered baseball is attached to the pulley which is free to move along the line. One person pitches the ball at one end and a second person swings with a bat at the other end. The ball has enough length on the tether to closely simulate the natural flight path of a ball.

DISCLOSURE OF THE INVENTION

Organized games using a ball and a bat or racket such as baseball, softball, tennis and racketball require either large open areas or courts with specific surfaces having nets or walls that meet precise specifications and criteria. It is therefore the primary object of the invention to duplicate a portion of the game using the ball hitting action with an implement having the same weight and feel also a ball of similar dimensions while restructing the area to a single straight line between objects. This invention not only replicates the hitting action with the appropriate implement providing practice for the real game but also creates a game by itself that improves reflexes, timing and bat or racket swinging techniques. Further, this game and apparatus may be used in a limited area outdoors or indoors in any weather using only a limited space between points over any terrain or surface.

An important object of the game allows pitching of the ball at controlled velocities permitting slow warm up and speeds duplicating the particular game. This action is controlled by the utilization of a bifurcated implement used by the throwing player in lever arm fashion with a flick of the wrist. This method of throwing or pitching the ball is easily controlled in velocities from 5 miles per hour (8 kilometers per hour) to in excess of 100 miles per hour (161 kilometers per hour) by the strength of the throw, wrist action and position of the grip relative to the implements length. In the case of the embodiment using rackets, the speed is not as important as it is in the baseball configuration, however, practice is easily accomplished to improve power and effectiveness of the racket stroke.

Another object of the invention allows the height of the ball to be easily adjusted for not only the particular game but the stature of the player. The angle of the line may also be varied such as inclined downwardly for slow pitch or inverting the angle of the pitch by lowering the pitchers end of the line simulating an upper arm softball pitch. The length of the line is also controllable depending upon the location of the attaching members which allows different velocities or duration of sight for the appropriate game simulation.

Still another object of the invention, particularly in the baseball embodiment, allows a competitive batting practice for those already utilizing batting machines either commercially or on a large playing area. The advantage is the speed in which the practice may be accomplished even up to 600 strikes per hour as no balls need to be retrieved and replaced in the machine and the same ball is always available as it is captivated on the line. The invention may be a valuable training tool as well as an enjoyable game.

Yet another object of the invention allows the game to be priced within the reach of the masses. Batting cages and mechanical pitching machines provide excellent training but are inherently complex and expensive to purchase. The invention is basically simple requiring only a few parts making the entire game easy to produce in quantity and is therefore cost effective.

A further object of the invention is directed to measuring the energy of the ball at the end of the travel along the taut line. This is accomplished by an accessory in the form of an impact meter consisting of a compression spring in a housing with a position indicator measuring the impact of the ball at the end of the line opposite the batter. With this device, the relative energy may be recorded and converted into meaningful data such as base hits, home runs and so on, in the game of baseball adding to the intrique of the game. An additional device creates a still another object of the invention. This ancillary device adds another element to the apparatus in the form of a angular line adjuster. This device allows a third player, simulating a baseball game, to act as the catcher and angularly manipulate the end of the line near the batter in a horizontal and vertical manner. The line movement at the precise time when the ball is being pitched along the line allows a curve or slider to be easily duplicated under complete control of the catcher. The curve may be inside or outside with a slider in a vertical direction or any combination therebetween.

A final object of the invention adds dynamics to the game for spectators watching at night. This feature is accomplished by the addition of a paint that glows in the dark or is fluorescent when illuminated by incandescent lighting. This decorative feature creates interest for those watching as the movement is clearly visible and easily seen.

BEST MODE FOR CARRYING OUT THE INVENTION

The best mode for carrying out the invention is presented in terms of a preferred, second and third embodiment. All three embodiments are primarily designed alike except additional elements are utilized for one, two or three players.

Figure 3:
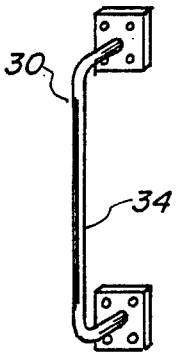
FIG. 3 is a partial isometric view of one of the line attaching members in the upright arm embodiment.
Figure 4:
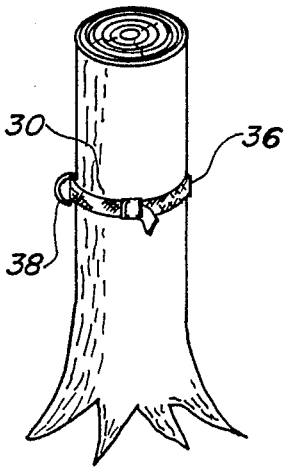
FIG. 4 is a partial isometric view of one of the line attaching members in the strap embodiment.
Figure 22:
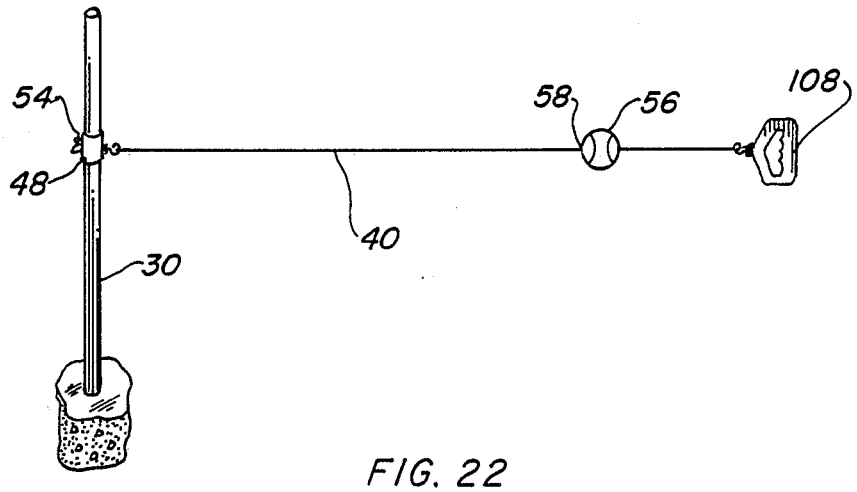
FIG. 22 is an illustration of a handle attached to one end of the line and a post on the other.
Figure 23:
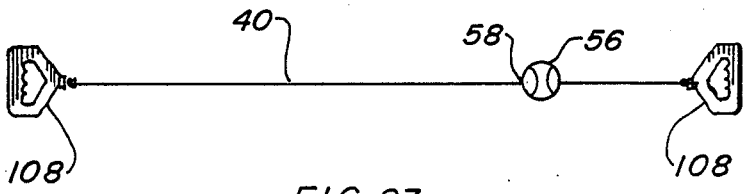
FIG. 23 is an illustration of the line attaching members as handles.

The preferred embodiment is for two players and is illustrated in FIGS. 1–13 and 15–18. This embodiment is comprised of a pair of spaced apart line attaching members 30 positioned at a predetermined distance according to the game being played. One configuration of the attaching members is illustrated in FIGS. 1, 2, 15, 16 and 19 and consists of one or two posts 32 buried in the ground in a vertical position. The post is preferably anchored in concrete and has sufficient structural integrity to maintain its relative position when pulled from one side. The post 32 may be metal or wood with metal pipe being preferred. Another configuration is illustrated in FIG. 3 and consists of an upright arm with radial ends 34 having a mounting plate attached to each end. The mounting plate contains a plurality of holes for mounting to a rigid structure with threaded fasteners or screws. Again metal pipe is the preferred material of construction. A third attaching member consists of a flexible strap 36, of woven natural fibre or plastic, with attaching means in the form of a "D" ring 38 held captive by the strap 36. The strap is installed around existing structure such as a tree trunk, shown in FIG. 4, or a utility pole, fence post or the like. The strap 36 is connected together with a buckle or like fastener well known in the art. Yet another configuration of the line attaching members 30 is depicted in FIGS. 22 and 23 and consists of one or more handles 108. The handles are held by a non-player and add portability to the game by not requiring a fixed attachment. Further, the non-players provide their own tensioning as the line is pulled tight when the game is played.

A line 40 is stretched between the attaching members 30 above the ground surface as shown in FIGS. 1, 8, 15, 16 and 19 and creates a directional guide therebetween. The line 40 may preferably be a wire rope, consisting of a plurality of wire strands from the center around which other strands are laid in a spiral manner. The outside surface may be plain or covered with a resilient thermoplastic coating impregnated around and through the exposed strands for wear resistance and protection. The line 40 may also be a woven fiberous cord with fibers layed in parallel and woven into a mass or ribbons spun into yarn twisted into strands in rope fashion. The flexibility of the line is limited only to its ability to be coiled up for storage and its ease of attachment on the ends.

Figure 24:
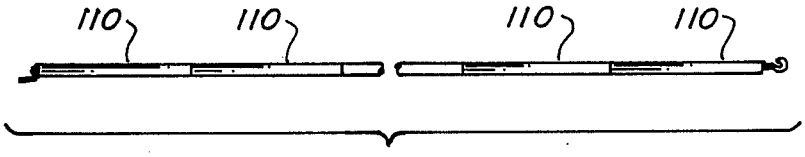
FIG. 24 is a view of a rigid line cut away in the middle for clarity.
Figure 25:
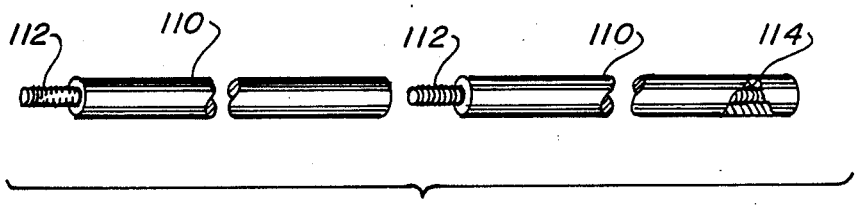
FIG. 25 is a partial isometric view of a rigid line showing the connecting means partially cut away for clarity.

Another type of line is shown in FIGS. 24 and 25 and consists of a plurality of rigid sections 110 having a male thread 112 on one end and a female thread 114 on the other. The rigid sections 110 are joined together sequencially by screwing the mating ends together forming a rigid line from one attaching member 30 to the other. The preferred material for the rigid sections of line is metal such as steel and aluminum or other material such as wood may be used with metal inserts or the like, for the threaded connections.

Figure 5:
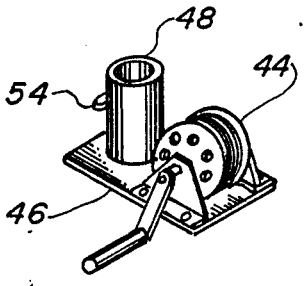
FIG. 5 is a fragmentary view of the line tensioning means in the winch embodiment.
Figure 6:
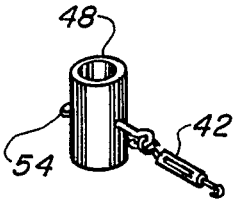
FIG. 6 is a fragmentary view of the line tensioning means in the turnbuckle embodiment.
Figure 7:
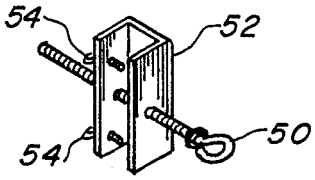
FIG. 7 is a fragmentary view of the line tensioning means in the threaded eye embodiment.

Line tensioning means are connected between the line 40 and the attaching members 30 causing the line to be taut creating a straight linear guide. The tensioning means may be in the form of a turnbuckle 42 with right and left handed eyes connected to a mating arbor shown in FIG. 6 or a winch 44 upon which the line 40 is wound. The winch is well known in the art, having a free spooling one way ratchet and an operating handle for rotating the spool to take up the slack in the line. FIG. 5 illustrates a winch 44 attached to a plate 46 with a sleeve 48. The plate 46 provides the platform and the sleeve 48 allows the tensioning means to be slid up or down the posts 32. It will be noted that other configurations of the tensioning means such as illustrated in FIG. 6 utilize the same sleeve 48. FIG. 7 depicts yet another configuration consisting of a threaded eye 50 having a swivel on the end and a threaded C shaped bracket 52 allowing the eye 50 to be rotated in the threads in the bracket changing the length of the line, creating or releasing tension. It will be noted that the line tensioning means in moving up and down on the pole, as noted above, are adjustably positioned by a retaining thumbscrew 54 in the side opposite the tensioning device. While the above embodiments are illustrated and described above the invention is not limited to these configurations as many other types of tensioning means may be employed such as knots, overcenter latches, cinches, and the like, and still remain within the scope of the invention.

The game includes a ball 56 shown in FIGS. 1, 8, 15, 16 and 19. This ball 56 is round and simulates the actual ball used in the game duplicated by the invention such as a baseball, softball, tennis ball, racketball and the like. Further, the ball 56 is either solid or hollow and contains a hole 58 therethrough allowing it to be strung on the line and move freely in a linear direction.

The composition and resiliently of the ball 56 will vary depending upon the particular game.

Figure 9:
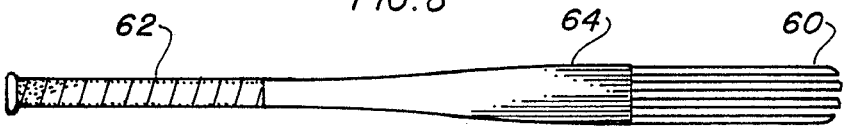
FIG. 9 is an illustration of the bat having extending fingers shown separately.
Figure 11:
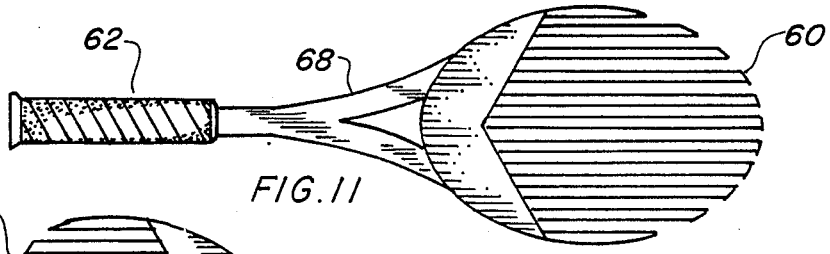
FIG. 11 is an illustration of a tennis-like racket shown separately.
Figure 12:
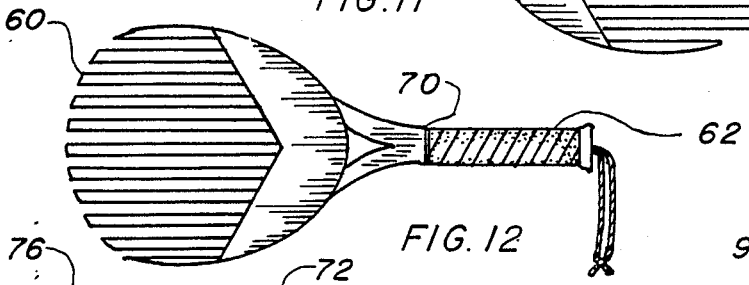
FIG. 12 is an illustration of a racketball-like racket shown separately.
Figure 13:
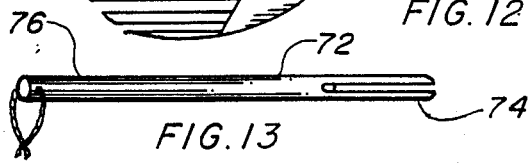
FIG. 13 is an illustration of a bifurcated ball launching implement shown separately.

A ball striking device is held by a player who swings at the ball 56 on the line 40. This device contains extended fingers 60 on one end and a gripping surface 62 on the other providing a striking force capable of propelling the ball 56 along the line 40 when hit by a player. The fingers 60 penetrate either side of the line 40 hitting only the ball 56. One configuration of this device is illustrated in FIG. 9 and consists of a bat 64 having cavities in the end through which the fingers 60 extend. A similar device is employed using a conventional baseball or softball bat with a ring 66 slipped over the small end held in place by the diametrical difference in size. The ring 66, shown in FIG. 10, contains the fingers 60 lengthening the effective range of the bat. The ring 66 is smaller in inside diameter than the outside diameter of the bat creating an interference for attachment. FIG. 11 illustrates a tennis like racket 68 duplicating, in size and weight, a conventional racket used in that sport. Similarly, FIG. 12 shows a racketball like racket 70. In both cases, the fingers 60 function in the same manner as the bats. The fingers 60 may be solid or hollow of any suitable material such as steel, aluminum, titanium, fiberglass or carbon lamination.

When simulating any game such as baseball or softball in particular, a bifurcated ball launching implement 72 is used. This device has forks 74 on one end and a handle 76 on the other allowing a player to orientate the forks 74 between the line 40 touching the ball 56 and propelling the ball down the line with a flick of the wrist.

Figure 1:
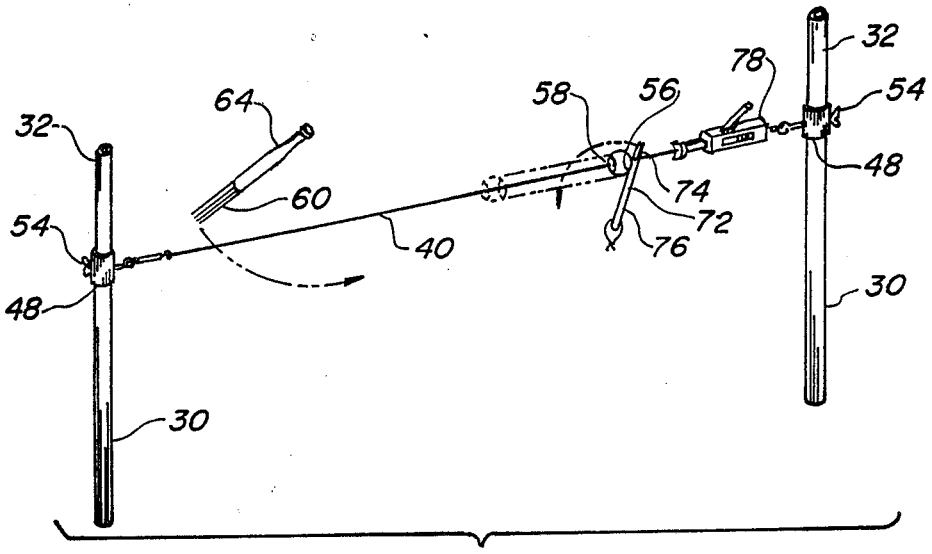
FIG. 1 is a partial isometric view of the preferred embodiment illustrates the ball striking device and launching implement arcuated rotating with phantom lines and directional arrows indicating course of travel.
Figure 2:
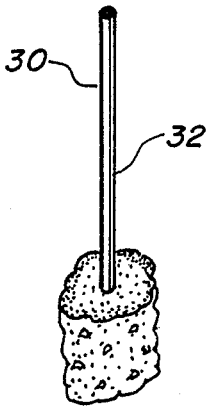
FIG. 2 is a partial isometric view of one of the line attaching members in the post embodiment isolated from the invention for clarity.
Figure 10:
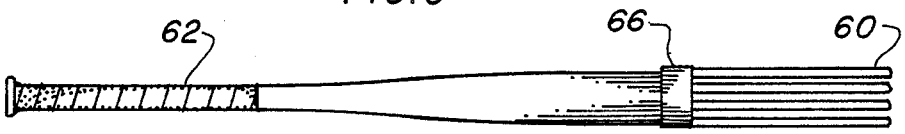
FIG. 10 is an illustration of the bat having a ring with extending fingers shown separately.

In the preferred embodiment, illustrated in FIG. 1, the game is played by two players, the first player is the batter and uses either a combined bat and ring 66, shown in FIG. 10, or the bat 64 shown in FIG. 9, and stands at one end of the line 40. The second player, the pitcher, throws or flips the ball with the launching implement 72 at the other end of the line. The first player swings at the ball 56 driving it back to the pitcher who then repeats the action. The use of an ancillary device in the form of an impact meter 78 allows the moment of inertia of the hit ball to be recorded and retained until reset by the pitcher.

Figure 17:
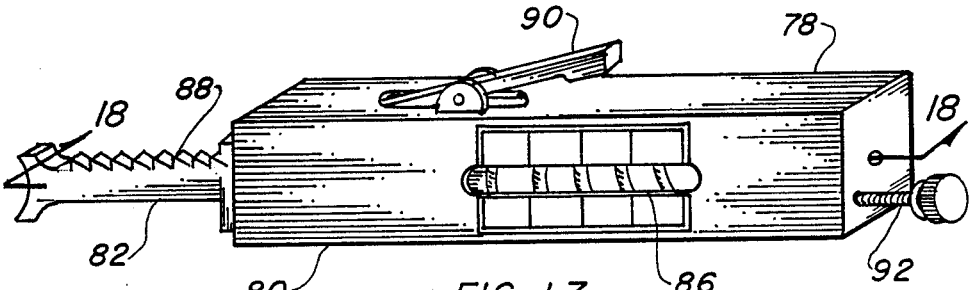
FIG. 17 is an illustration of the impact meter removed from the line for clarity.
Figure 18:
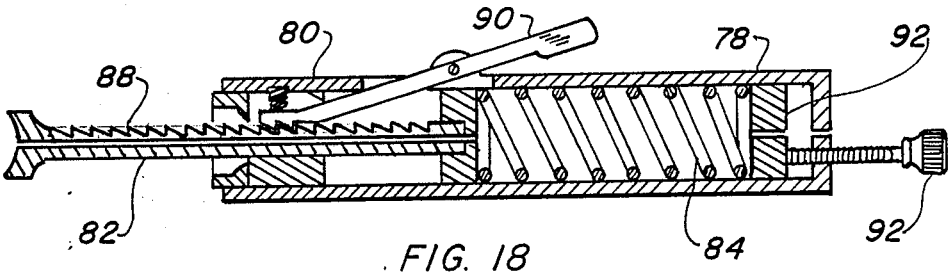
FIG. 18 is a cross-sectional view taken along lines 18—18 of FIG. 17.

This impact meter 78 is illustrated in FIGS. 17 and 18 and consists of a housing 80 having a hollow interior and an extended plunger 82, having a hole in the middle, slideably positioned in the housing. The hole encompasses the line 40 and the housing 80 has a similar orifice in the end opposite the plunger 82 also being aligned by the line 40. A spring 84 is positioned between the plunger 82 and the end of the housing 80 that yieldingly compresses when impacted by the ball 56. An opening 86 in one or both sides of the housing 80 allows visual indication of how far the spring 84 compresses defining measuring means for the meter 78. The plunger 82 contains a female set of grooved teeth 88 in the top thereof and the housing 80 employs a spring loaded ratchet handle 90 that mates with the teeth 88 allowing the plunger to move inwardly in the housing 80 against the spring and be retained by the ratchet actions of the handle locking into the teeth of the grooves 88. The second player after reading the meter releases the plunger 82 by depressing the handle 90 allowing the plunger 82 to extend fully under the influence of the spring 84. The side of the housing may contain indica denoting appropriate values relative to a baseball game such as, base hit, or single, two base hit or double etc. Further, the degree of difficulty may be adjusted by spring adjusting means 92 consisting of a threaded knob and spacer allowing the spring 84 to be precompressed by turning the knob shortening the stroke of the spring increasing the tension and therefore the relative movement upon impact.

Figure 8:
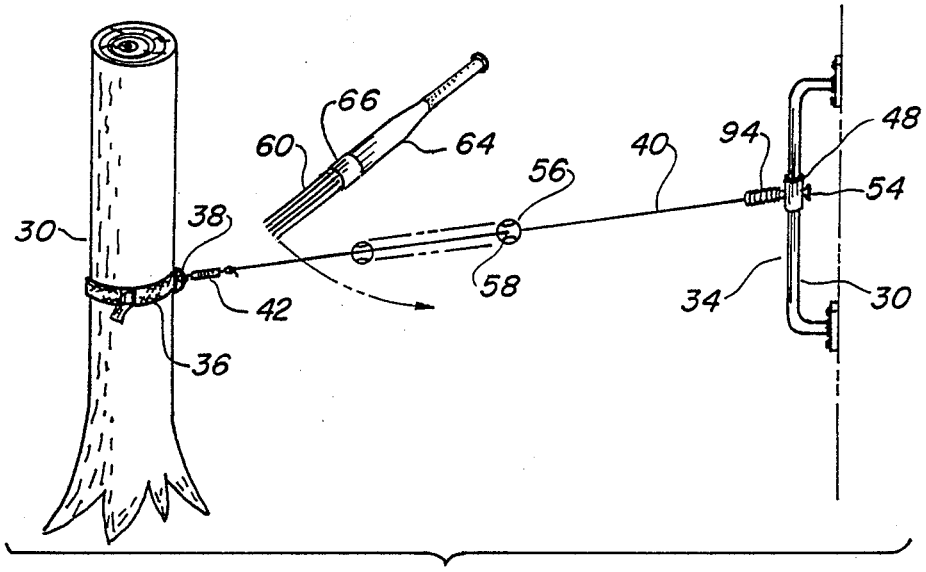
FIG. 8 illustrates the ball striking device and ball on the line with a spring surrounding the flexible line and attaching members with one having mounting plates and the other a strap.
Figure 14:
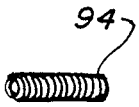
FIG. 14 is an illustration of a spring as shown in FIG. 8 shown separately.

The second embodiment illustrated in FIG. 8 is played with one player utilizing the same elements as previously described except the launching implement 72 is not used and a compression spring 94 is added to the line at the end of the line opposite the player. This spring 94 is shown by itself in FIG. 14 and installed on the line in FIG. 8 its function is to return the ball 56 to the player after it is hit by the striking device. Any one of the devices for hitting the ball 56 may be used with equal ease.

Figure 19:
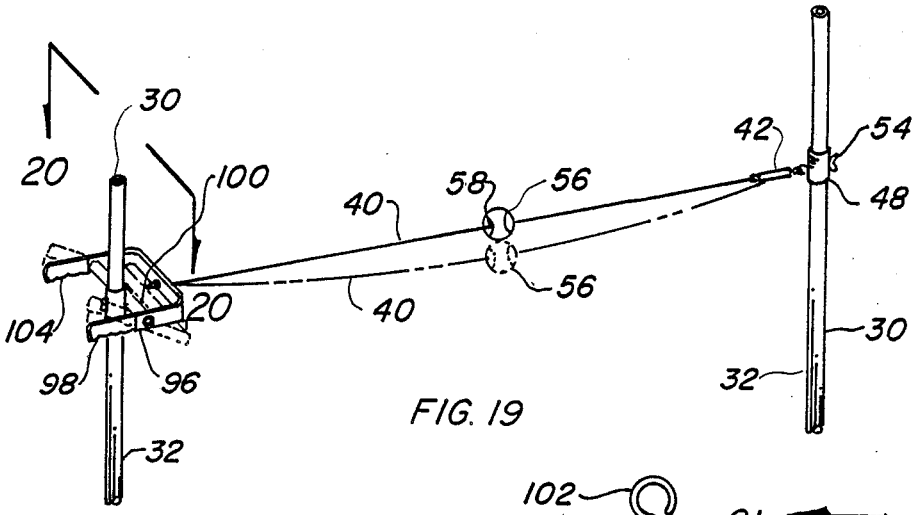
FIG. 19 is an illustration of the embodiment for three players including the angular line adjuster attached to one of the attaching members.
Figure 20:
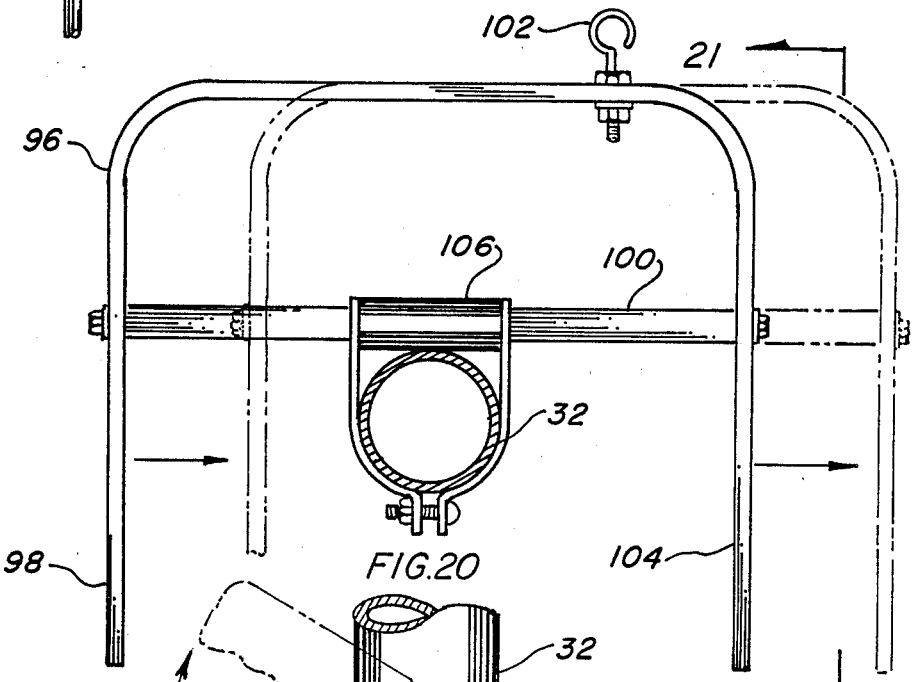
FIG. 20 is a cross-sectional view taken along lines 20—20 of FIG. 19 with the adjuster slid sideways in phantom illustrating the movement capability.
Figure 21:
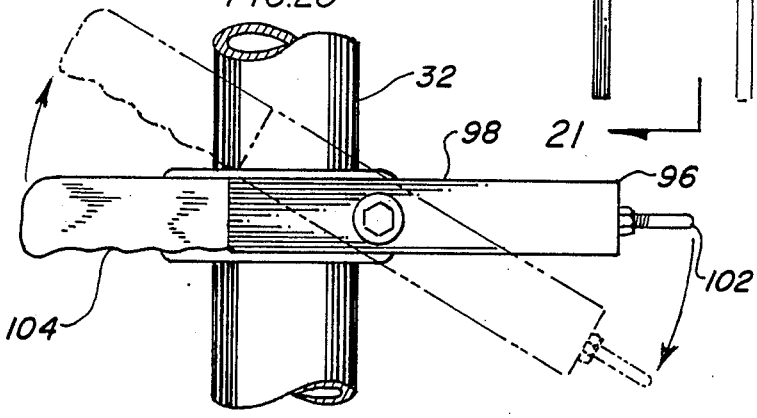
FIG. 21 is a cross-sectional view taken along lines 21—21 of FIG. 20 with the adjuster rotated downward in phantom illustrating the movement capability.

The third embodiment, shown in FIG. 19, is played with three players. The first and second are the same as the preferred embodiment with an addition of a catcher. The purpose of the third player, or catcher, is to make the ball 56 curve as it travels along the line 40. This effect is created by the addition of an angular line adjuster 96 shown in plan and elevation views in FIGS. 20 and 21. This adjuster 96 allows the third player to manipulate the line in any angular direction causing the ball 56 propelled by the second player to curve or slide like a pitched ball in the game of baseball. This adjuster 96 consists of a first 98 and second 100 member attached together on each end. The first member 98 contains a rigid eye 102 in the center thereof for connecting the end of the line 40. A pair of handles 104, one on each end, extend at right angles from the second member 100 for gripping, and, slideable means, in the form of a cylindrical sleeve 106 is adjustably connected to one of the line attaching members 30. The second member 100 is round and penetrates the sleeve 106 allowing the adjuster to be slid from side to side or rotated up or down simultaneously while the ball 56 is traveling along the line 40. The third embodiment is ideally suited for duplicating the game of baseball and allows valuable practice for hitting curve balls that has been heretofore available in mechanical pitching devices.

Another variation of the angular line adjuster 96 is a handle 108 held by the third player or catcher. This handle 108 combines the adjuster 96 and line attaching member 30 as the line is still attached to a rigid member 30 as illustrated in FIG. 22. The catcher pulls the line taut while manipulating the line 40 any direction to simulate a curve ball or similar arc path.

Figure 15:
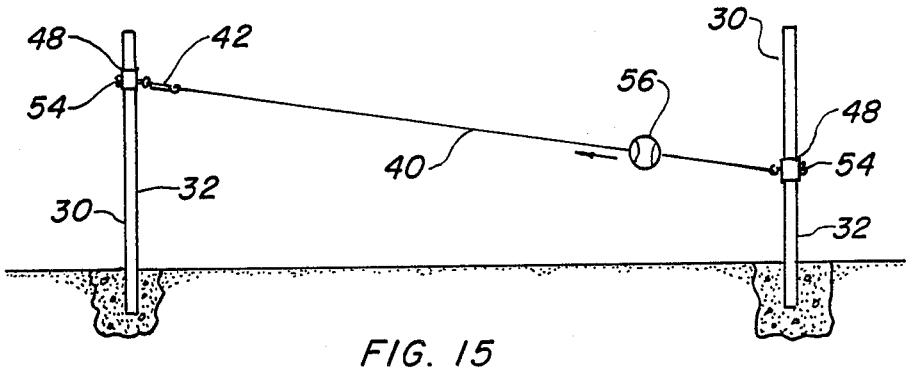
FIG. 15 is an illustration of the line inclined upwardly.
Figure 16:
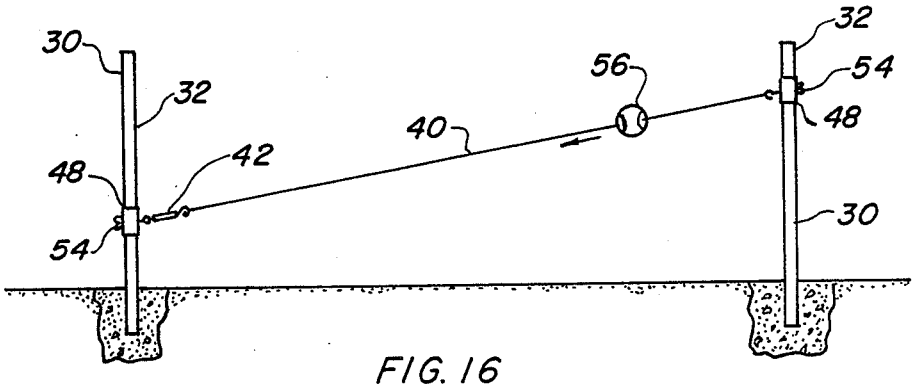
FIG. 16 is an illustration of the line inclined downwardly.

In all three embodiment, the line 40 may be angled up or down as shown in FIGS. 15 and 16 to simulate slow pitch softball descending toward the player or baseball traveling upward such as in a side arm pitch increasing the flexibility of the game. Further, the line 40, ball 56 and ball striking device 64, 68 or 70 may be coated with fluorescent paint either entirely or striped to enable others to see the movement when illuminated by night. This addition of special paint may also include luminescent material that may be exposed to light and retain its luminescent quantities allowing a portable light or flashlight to be used to glow in the dark where no city power is available for lighting.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. A ball batting game apparatus for playing with two players comprising:

(a) a pair of spaced-apart line-attaching members positioned at a predetermined distance, (b) a line between and contiguous with said attaching members above a ground surface providing a directional guide therebetween, (c) line tensioning means connected between the line and the attaching members causing the line to be taut defining a relatively straight linear guide between the members, (d) a ball having a hole in the center thereof disposed on the line through the hole allowing the ball to move freely on the line in a linear direction, (e) a ball striking device held by a player having extended fingers on one end and a gripping surface on the other providing a striking force to propel the ball along the line when hit by the player, with the fingers penetrating either side of the line hitting only the ball when the player arcuately swings the striking device, and (f) a bifurcated ball launching implement held by the other player, the implement having forks on one end and a handle surface on the other allowing the remaining player to orientate the forks on the line contiguous with the ball and propel the ball with a flip of the player's wrist to the player having the striking device in a pitching manner allowing the striking device to be swung impacting the ball thrusting it back toward the remaining player in a hitting manner duplicating, in constraint, a game using a ball and a bat or racket.

2. The ball batting game apparatus as recited in claim 1 wherein said line attaching members further comprise at least one post positioned rigidly in the ground with one end retained in the ground and the remaining portion oriented in a vertical position with the post having sufficient structural integrity to maintain its relative position when strain is placed therebetween by the tensioning members.

3. The ball batting game apparatus as recited in claim 1 wherein said line attaching members further comprise at least one upright arm with radial ends having a mounting plate on the ends thereof for attachment to a rigid surface such as a building or structure.

4. The ball batting game apparatus as recited in claim 1 wherein said line attaching members further comprise a strap having adjustable connecting means and a line fastener thereon allowing attachment of the line to a tree, pole or other rigid vertical structure around the perimeter thereof.

5. The ball batting game apparatus as recited in claim 4 wherein said line fastener further comprises a "D" ring held captive by the strap providing a mounting surface for said line tensioning means.

6. The ball batting game apparatus as recited in claim 1 wherein said line attaching member further comprises a plurality of handles held by one or more non players providing portable attachment of the line and manual tensioning thereof.

7. The ball batting game apparatus as recited in claim 1 wherein said line further comprises a flexible wire rope consisting of a plurality of wire strands one strand forming the center around which the other strands are laid in a spiral manner.

8. The ball batting game apparatus as recited in claim 7 further comprising a resilient thermoplastic coating over and impregnated through the wire rope for wear resistance and protection.

9. The ball batting game apparatus as recited in claim 1 wherein said flexible line further comprises a woven fibrous cord with fibers laid in parallel and woven into a homogenous mass.

10. The ball batting game apparatus as recited in claim 1 wherein said flexible line further comprises a rope consisting of ribbons spun into yarn twisted into strands.

11. The ball batting game apparatus as recited in claim 1 wherein said line further comprises a plurality of rigid sections having male and female threads on each end joined together by sequentially connecting the ends together forming a rigid line from one attaching member to the other.

12. The ball batting game apparatus as recited in claim 1 wherein said line tensioning means further comprises a turnbuckle having an arbor with right and left hand threaded eyes rotatably disposed on each end shortening the distance between the eyes when rotating the arbor allowing the line to be tensioned between the attaching members.

13. The ball batting game apparatus as recited in claim 1 wherein said line tensioning means further comprise a winch upon which the line is wound, said winch having a free-spooling one-way ratchet with an operating handle, when the handle is rotated, the line is wound tight around the spool with the ratchet maintaining the tension by the relative position of the ratchet.

14. The ball batting game apparatus as recited in claim 1 wherein said line tensioning means further comprises a threaded eye having a swivel and a threaded C shaped bracket such that when the eye is rotated within the bracket, the relative length of the line is shortened creating the tension on the line.

15. The ball batting game apparatus as recited in claim 1 wherein said ball is hollow having sufficient structural integrity to withstand the impact of the striking device.

16. The ball batting game apparatus as recited in claim 1 wherein said ball is solid having sufficient resiliency to respond to the impact of the striking device when swung by the player.

17. The ball batting game apparatus as recited in claim 1 wherein said ball striking device further comprises a bat having cavities in one end with said extended fingers connected integrally to the cavities in the end opposite the handle.

18. The ball batting game apparatus as recited in claim 1 wherein said ball striking device further comprises a baseball bat and a ring having an inside diameter less than the outside diameter of the bat, with said plurality of extended fingers connected to and extending from the ring in such a manner as to lengthen the bat when the ring is placed thereon held in place by the diametrical difference in the bat and ring.

19. The ball batting game apparatus as recited in claim 1 wherein said ball striking device further comprises a racket having the handle with a gripping surface and the extending finger end radiused in a tennis racket manner duplicating the weight and feel of a racket used to play tennis.

20. The ball batting game apparatus as recited in claim 1 wherein said ball striking device further comprises a racket having the handle with a gripping surface and the extending finger end radiused in a racketball, racket manner duplicating the weight and feel of a racket used to play racketball.

21. The ball batting game apparatus as recited in claim 1 further comprising an impact meter with (a) a ratcheted housing having a hollow interior, ( b) an extended ratcheted plunger having a hole centrally positioned therein located within the housing with the hole encompassing the line, ( c) a spring contiguous with said plunger positioned within the housing with one end touching the plunger yielding when the ball impinges thereon in a compressable manner, (d) measuring means to indicate and retain the movement of the plunger so as to record the energy of the ball remaining at the end of the travel along the line, and (e) reset means integral with the meter allowing the ratchet of the housing and plunger to be released after measurement has taken place by the player.

22. The ball batting game apparatus as recited in claim 21 further comprising: said line, ball and ball striking device coated with fluorescent paint allowing the moving elements of the game to be seen by others when illuminated at night.

23. The ball batting game apparatus for playing ball with one player comprising:

(a) a pair of spaced-apart line attaching members positioned at a predetermined distance, (b) a line between and contiguous with said attaching members above a ground surface providing a directional guide therebetween, (c) line tensioning means connected between the line and the attaching members causing the line to be taut defining a relatively straight linear guide between the members, (d) a ball having a hole in the center thereof disposed on the flexible line through the hole allowing the ball to move freely on the line in a linear direction, (e) a ball striking device held by the player having extended fingers on one end and a gripping surface on the other providing a striking force to propel the ball along the line when hit by the player, with the fingers penetrating either side of the line hitting only the ball when the player arcuately swings the striking device, and, (f) a spring surrounding said line on an end adjacent to one of said attaching members allowing said player at an opposite end to hit the ball with the striking device driving it along the line impacting the spring such that it rebounds to the player.

24. The ball batting game apparatus as recited in claim 23 further comprising: said line, ball and ball striking device coated with fluorescent paint allowing the moving elements of the game to be seen by others when illuminated at night.

25. The ball batting game apparatus for playing ball with three players comprising:

(a) a pair of spaced-apart line-attaching members positioned at a predetermined distance, (b) a line between and contiguous with said attaching members above a ground surface providing a directional guide therebetween, (c) line tensioning means connected between the line and the attaching members causing the line to be taut defining a relatively straight linear guide between the members, (d) a ball having a hole in the center thereof disposed on the flexible line through the hole allowing the ball to move freely on the line in a linear direction.

(e) a ball striking device held by a first player having extended fingers on one end and a gripping surface on the other providing a striking force to propel the ball along the line when swung by the first player, with the fingers penetrating either side of the line hitting only the ball when the first player arcuately swings the striking device, (f) a bifurcated ball launching implemented held by a second player, the implement having forks on one end and a handle surface on the other allowing the second player to orientate the forks on the line contiguous with the ball and propel the ball with a flip of the second player's wrist to the first player having the striking device in a pitching manner allowing the striking device to be swing impacting the ball thrusting it back toward the second player in a hitting manner duplicating, in constraint, a game using a ball and a bat or racket, and (g) an angular line adjuster providing a manually adjustable angle of the line at the attaching member nearest the first player allowing a third player to manipulate the line causing the ball, propelled by the second player, to curve or slide like a pitched ball in the game of baseball.

26. The ball batting game apparatus as recited in claim 25 wherein said angular line adjuster further comprises a first and a second parallel member attached together on each end, a line attaching rigid eye in the center of the first member for connecting the line, a pair of handle means one on each end of the second parallel member for manual manipulation, and, slideable means, interfacing said adjuster to said line attaching members allowing the adjuster to be slid from side to side and rotated simultaneously defining infinite angular combinations while the ball is traveling along the line.

27. The ball batting game apparatus as recited in claim 25 wherein said angular line adjuster further comprises a handle held by the third player as a combined line attaching member and a line adjuster.

28. The ball batting game apparatus as recited in claim 25 further comprising said line, ball and ball striking device coated with fluorescent paint allowing the moving elements of the game to be seen by others when illuminated at night.

* * * * *